US008506388B2

(12) United States Patent
Walker et al.

(10) Patent No.: US 8,506,388 B2
(45) **Date of Patent: *Aug. 13, 2013**

(54) METHOD AND APPARATUS FOR CONDITIONAL PAYOUTS IN A GAMING DEVICE

(75) Inventors: Jay S. Walker, Ridgefield, CT (US); Russell P. Sammon, San Francisco, CA (US); Jeffrey Y. Hayashida, San Francisco, CA (US); Daniel E. Tedesco, Huntington, CT (US); Robert C. Tedesco, Fairfield, CT (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/417,823

(22) Filed: Mar. 12, 2012

(65) Prior Publication Data

US 2012/0172114 A1 Jul. 5, 2012

Related U.S. Application Data

(63) Continuation of application No. 11/814,373, filed as application No. PCT/US2006/029261 on Jul. 25, 2006, now Pat. No. 8,142,280.

(51) Int. Cl.
*A63F 9/24* (2006.01)

(52) U.S. Cl.
USPC ..... 463/25; 463/29

(58) Field of Classification Search
USPC ..... 463/25, 29
See application file for complete search history.

(56) References Cited

U.S. PATENT DOCUMENTS

| | | | |
|---|---|---|---|
| 3,810,627 | A | 5/1974 | Levy |
| 3,909,002 | A | 9/1975 | Levy |
| 4,669,731 | A | 6/1987 | Clarke |
| 4,679,143 | A | 7/1987 | Hagiwara |
| 4,766,539 | A | 8/1988 | Fox |
| 4,826,169 | A | 5/1989 | Bessho et al. |
| 5,178,390 | A | 1/1993 | Okada |
| 5,179,517 | A | 1/1993 | Sarbin et al. |
| 5,320,356 | A | 6/1994 | Cauda |
| 5,483,444 | A | 1/1996 | Heintzeman et al. |
| 5,511,781 | A | 4/1996 | Wood et al. |

(Continued)

FOREIGN PATENT DOCUMENTS

| | | |
|---|---|---|
| JP | 2003154062 A | 5/2003 |
| WO | WO 01/70355 | 9/2001 |
| WO | WO 03/089092 | 10/2003 |

OTHER PUBLICATIONS

Regan, Jim, "Winning at Slot Machines—A Guide to Making Money at the Most Popular of all Casino Games", Carol Publishing Group Edition, Copyright 1985, 5 pp.

(Continued)

*Primary Examiner* — Pierre E Elisca
(74) *Attorney, Agent, or Firm* — Neal, Gerber & Eisenberg LLP

(57) ABSTRACT

A gaming device incentivizes additional game play by combining payouts with conditional payouts. During game play, players are informed of the conditions, which must be satisfied so as to vest the conditional payouts. Subsequent game play is monitored to see if the player has satisfied the conditions. If the player has satisfied the conditions, then the conditional payout vests. If the condition is not met, then the conditional payout terminates.

20 Claims, 12 Drawing Sheets

(56) References Cited

U.S. PATENT DOCUMENTS

| | | | | |
|---|---|---|---|---|
| 5,542,669 | A | 8/1996 | Charron et al. | |
| 5,601,488 | A | 2/1997 | Kadlic | |
| 5,674,128 | A | 10/1997 | Holch et al. | |
| 5,695,402 | A | 12/1997 | Stupak | |
| 5,704,835 | A | 1/1998 | Dietz | |
| 5,720,662 | A | 2/1998 | Holmes, Jr. et al. | |
| 5,752,882 | A | 5/1998 | Acres et al. | |
| 5,766,075 | A | 6/1998 | Cook et al. | |
| 5,775,992 | A | 7/1998 | Wood et al. | |
| 5,876,284 | A | 3/1999 | Acres et al. | |
| 5,910,048 | A | 6/1999 | Feinberg | |
| 5,967,896 | A | 10/1999 | Jorasch et al. | |
| 5,971,850 | A | 10/1999 | Liverance | |
| 5,988,638 | A | 11/1999 | Rodesch et al. | |
| 6,033,307 | A | 3/2000 | Vancura | |
| 6,056,642 | A | 5/2000 | Bennett | |
| 6,086,066 | A | 7/2000 | Takeuchi et al. | |
| 6,089,977 | A | 7/2000 | Bennett | |
| 6,113,493 | A | 9/2000 | Walker et al. | |
| 6,142,872 | A | 11/2000 | Walker et al. | |
| 6,176,781 | B1 | 1/2001 | Walker et al. | |
| 6,190,254 | B1 | 2/2001 | Bennett | |
| 6,227,972 | B1 | 5/2001 | Walker et al. | |
| 6,251,013 | B1 | 6/2001 | Bennett | |
| 6,254,482 | B1 | 7/2001 | Walker et al. | |
| 6,302,790 | B1 | 10/2001 | Brossard | |
| 6,319,125 | B1 | 11/2001 | Acres | |
| 6,343,989 | B1 | 2/2002 | Wood et al. | |
| 6,375,187 | B1 | 4/2002 | Baerlocher | |
| 6,537,150 | B1 | 3/2003 | Luciano et al. | |
| 6,585,592 | B1 | 7/2003 | Crumby | |
| 6,605,002 | B2 | 8/2003 | Baerlocher | |
| 6,855,054 | B2 | 2/2005 | White et al. | |
| 6,875,106 | B2 | 4/2005 | Weiss et al. | |
| 6,884,168 | B2 | 4/2005 | Wood et al. | |
| 6,918,834 | B2 | 7/2005 | Vancura | |
| 7,001,278 | B2 | 2/2006 | Maya et al. | |
| 7,025,674 | B2 * | 4/2006 | Adams et al. | 463/1 |
| 7,077,746 | B2 | 7/2006 | Torango | |
| 7,758,421 | B2 | 7/2010 | Hornik et al. | |
| 2002/0065131 | A1 | 5/2002 | Seelig et al. | |
| 2002/0103021 | A1 | 8/2002 | Wood et al. | |
| 2002/0175466 | A1 | 11/2002 | Loose et al. | |
| 2003/0008698 | A1 | 1/2003 | Stone | |
| 2003/0032470 | A1 | 2/2003 | Weiss et al. | |
| 2003/0050108 | A1 | 3/2003 | Gauselmann | |
| 2003/0199312 | A1 | 10/2003 | Walker et al. | |
| 2004/0097280 | A1 | 5/2004 | Gauselmann | |
| 2006/0111169 | A1 | 5/2006 | Hornik | |
| 2008/0102921 | A1 | 5/2008 | Urquhart | |
| 2008/0182643 | A1 * | 7/2008 | Seelig et al. | 463/20 |
| 2009/0117974 | A1 | 5/2009 | Hornik | |

OTHER PUBLICATIONS

Marshall, Fey, "Slot Machines", First Edition 1983, p. 162, 2pp.
Office Action for U.S. Appl. No. 10/395,621, dated Oct. 6, 2006, 8 pp.
Office Action for U.S. Appl. No. 10/395,621, dated May 3, 2007, 17 pp.
Office Action for U.S. Appl. No. 10/395,621, dated Dec. 21, 2007, 18 pp.
Notice of Allowability for U.S. Appl. No. 10/395,621 dated Apr. 18, 2008, 4pp.
Office Action for U.S. Appl. No. 10/328,116, dated Oct. 3, 2006, 10 pp.
Office Action for U.S. Appl. No. 10/328,116, dated Mar. 22, 2007, 16 pp.
Notice of Allowability for U.S. Appl. No. 10/328,116, dated Sep. 7, 2007, 7 pp.
Notice of Allowability for U.S. Appl. No. 10/328,116, dated Mar. 31, 2008, 4 pp.
The International Search Report for PCT Application No. PCT/US06/29261, dated May 28, 2008, 4 pp.
Written Opinion of the International Searching Authority for PCT Application No. PCT/US06/29261, dated May 28, 2008, 6 pp.
The International Search Report for PCT Application No. PCT/US03/09177, dated Jun. 23, 2003, 6 pp.
The International Search Report for PCT Application No. PCT/US03/08729, dated Jul. 24, 2003, 3 pp.

* cited by examiner

130

| PRIZE PACKAGE ID (132) | CONTENTS OF PRIZE PACKAGE (134) |
|---|---|
| PKG-001 | 15 COINS AFTER COMPLETING 50 MORE SPINS |
| PKG-002 | 136 20 COINS IMMEDIATELY, AND<br>138 10 COINS EVERY 50 SPINS, UP TO A MAXIMUM OF 30 COINS (3 SUB-PORTIONS) |
| PKG-003 | 3 COINS AS A CONSOLATION PRIZE FOR NEXT 4 LOSSES |
| PKG-004 | 7 COINS IMMEDIATELY, AND<br>3 COINS AS A CONSOLATION PRIZE FOR NEXT 4 LOSSES |
| PKG-005 | 5 COINS EVERY MINUTE FOR NEXT 5 MINUTES (25 COINS TOTAL) |
| PKG-006 | 30 COINS AT THE END OF THE HOUR (E.G., AT 3:00PM) |
| PKG-007 | 1 COIN FOR EVERY COIN DEPOSITED INTO THE GAME MACHINE DURING THE NEXT 10 MINUTES (MAX OF 20 COINS AWARDED) |
| ⋮ | ⋮ |
| PKG-00N | 6 COINS IMMEDIATELY, AND<br>2 COINS FOR EVERY 20 COINS WAGERED ON THE GAME MACHINE, UP TO A MAXIMUM OF 18 COINS AWARDED (9 SUB-PORTIONS) |

FIG. 6

150

| PLAYER IDENTIFIER 152 | NAME 154 | ADDRESS 156 | PLAYER SINCE 158 | TOTAL WAGERED 160 | ELIGIBLE FOR PRIZE PACKAGE 162 | THEORETICAL WIN 164 | PRIZE PACKAGE PREFERENCE 166 | PRIZE PACKAGES ACTIVE 168 |
|---|---|---|---|---|---|---|---|---|
| P-000001 | BOB JONES | 15 ELM ST. SPRINGTOWN, NY | 11/20/99 | $1,535.00 | YES | $138.15 | YES | PKG-001 |
| P-000002 | MARIA LOPEZ | 36 GUMDROP DR. CAPITAL CITY, CA | 7/28/04 | $168.50 | NO | $15.17 | - | - |
| ⋮ | | ⋮ | | ⋮ | | ⋮ | | ⋮ |
| P-106998 | CHARLES WILLIAMS | 140 MAIN ST. PRAIRIEVILLE, ND | 1/15/93 | $19,754.25 | YES | $1,777.88 | NO | NONE |
| P-106999 | KLYE SMITH | 65 BEACH LN. # 1 BEACH CITY, NJ | 3/26/98 | $980.10 | YES | $88.21 | YES | PKG-002 PKG-004 |

FIG. 7

170

| 172 PLAYER ID | 174 PRIZE PACKAGE ID | 176 NON-VESTED SUB-PORTION ID | 178 SUB-PORTION VALUE | 180 VESTING EVENT | 182 PAID? |
|---|---|---|---|---|---|
| P-000001 | PKG-001 | PKG-001-0001 | 15 COINS | SPIN-COUNTER = 54 | Y |
| ⋮ | ⋮ | ⋮ | ⋮ | ⋮ | ⋮ |
| P-106999 | PKG-002 | PKG-002-0001 | 10 COINS | SPIN-COUNTER = 60 | N |
| | | PKG-002-0002 | 10 COINS | SPIN-COUNTER = 110 | N |
| | | PKG-002-0003 | 10 COINS | SPIN-COUNTER = 160 | N |
| | PKG-004 | PKG-004-0001 | 3 COINS | LOSS-COUNTER = 1 | Y |
| | | PKG-004-0002 | 3 COINS | LOSS-COUNTER = 2 | N |
| | | PKG-004-0003 | 3 COINS | LOSS-COUNTER = 3 | N |
| | | PKG-004-0004 | 3 COINS | LOSS-COUNTER = 4 | N |

FIG. 8

METHOD AND APPARATUS FOR CONDITIONAL PAYOUTS IN A GAMING DEVICE

PRIORITY CLAIM

This application is a continuation application of, claims the benefit of and priority to U.S. patent application Ser. No. 11/814,373, filed on Jul. 20, 2007, which claims the benefit of and priority to International Application No. PCT/US2006/029261, filed on Jul. 25, 2006, the entire contents of each are incorporated by reference herein.

CROSS-REFERENCE TO RELATED APPLICATIONS

The present application is related to U.S. patent application Ser. No. 10/328,116, filed on Dec. 20, 2002, and U.S. patent application Ser. No. 10/395,621, filed on Mar. 21, 2003.

FIELD OF THE INVENTION

The present invention relates to gaming devices and in particularly to payouts in a gaming device.

BRIEF DESCRIPTION OF THE DRAWINGS

FIG. 6 illustrates a prize package database according to an exemplary embodiment of the present invention;

FIG. 7 illustrates a player database that may be used with some embodiments of the present invention;

FIG. 8 illustrates a modified player database in one embodiment of the present invention tracking prize packages;

DETAILED DESCRIPTION OF THE INVENTION

Gambling is a highly profitable form of entertainment for gaming establishments. As such, there is a general need for ways in which to make the gambling experience more exciting so as to continue to attract gambling patrons.

At least some embodiments of the present invention enliven the gambling experience at a gaming device by providing players with a prize package that includes at least a non-vested portion along with conditions under which the players may vest the non-vested portion. In some embodiments, the condition relates to continued play at the gaming device. Players are incentivized to continue playing so that they may receive the non-vested portion. For example, if a player is using a slot machine, a player begins play at the slot machine by inserting cash (e.g., one dollar) into a bill acceptor of the slot machine. The player wagers twenty-five cents and pulls the handle or presses a button to initiate the spinning of the reels (reducing the available balance to \$0.75). The reels stop and provide an outcome to the player (e.g., cherry-cherry-cherry). The player is immediately awarded a vested benefit of fifteen units of wager (and since the wager was \$0.25, the fifteen units equals \$3.75, thus raising the available balance to \$4.50). Concurrently, the gaming device associates with the player a non-vested benefit of eleven units of wager whose vesting is conditioned upon the player making ten more handle pulls. The gaming device informs the player that if she continues playing the slot machine for an additional ten handle pulls, the non-vested benefit will vest. Game play resumes. If the player discontinues play after only eight more handle pulls, the non-vested benefit expires or is terminated. However, if the player continues play for ten more handle pulls, losing her wager each time (thus reducing the balance to \$2.00 (10 wagers×\$0.25/wager=\$2.50; \$4.50−\$2.50=\$2.00), the non-vested portion vests, in effect becoming a secondary vested portion, and the balance for the player is increased by the eleven units of wager raising the available balance to \$4.75 (11×\$0.25=\$2.75; \$2.75+\$2.00=\$4.75). In essence, the non-vested benefit is a conditional benefit whose condition must be satisfied before the non-vested benefit is vested.

Before addressing the particularly contemplated embodiments of the present invention, an overview of exemplary gaming devices and a gaming establishment server on which embodiments of the present invention may be implemented are provided. The discussion of the particularly contemplated details of the embodiments begins below with reference to FIG. 5.

Figure 1:
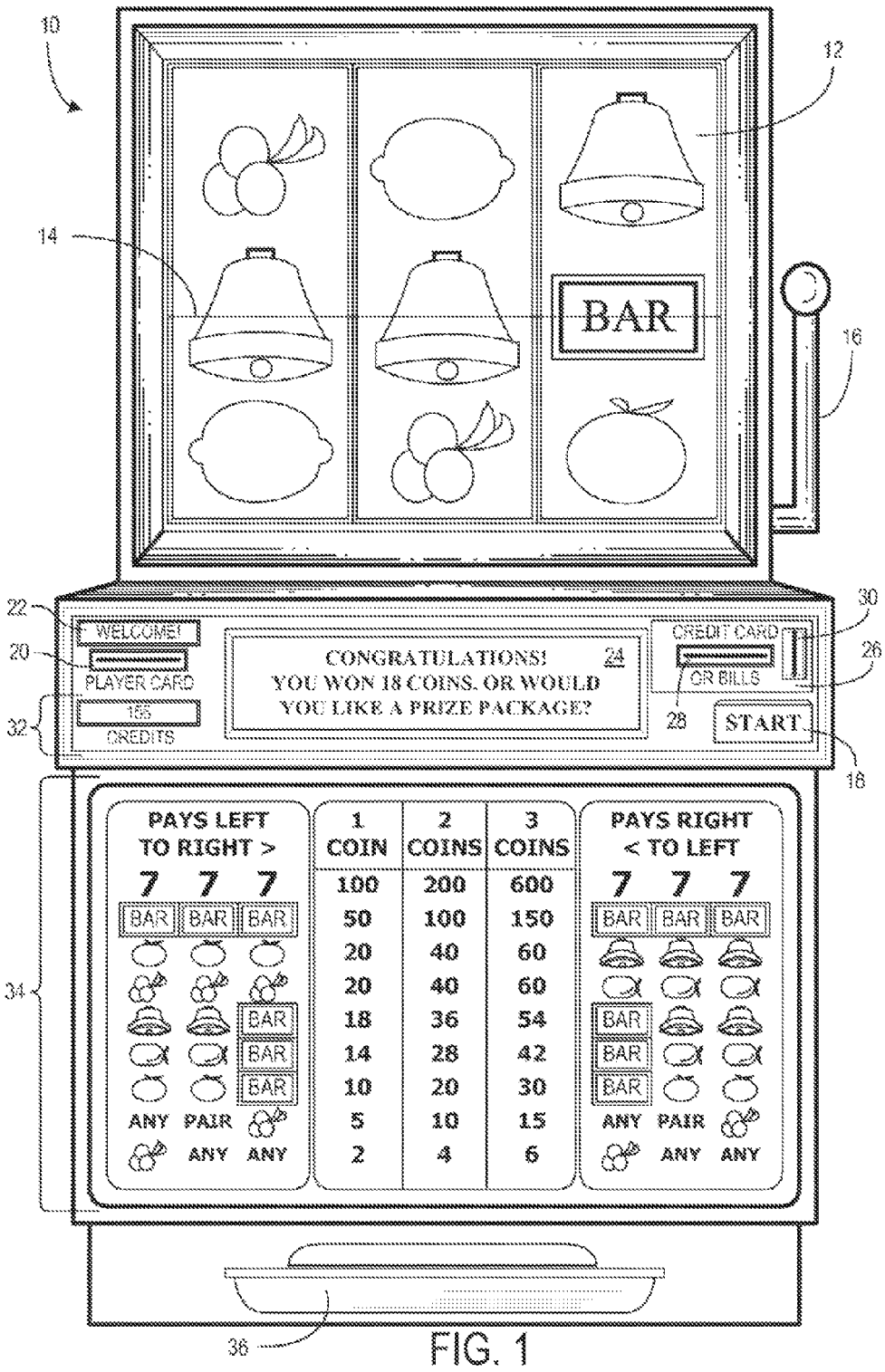
FIG. 1 illustrates an exemplary gaming device suitable for use with some embodiments of the present invention.

FIG. 1 illustrates a front elevational view of a gaming device, which is, as illustrated, a three-reel slot machine 10 that may be used in accordance with some embodiments. The slot machine 10 includes a housing that delimits a display area 12 in which an outcome for a game of the slot machine 10 is displayed to the player on payline 14. The display area 12 may, for example, be a video display that displays simulations of reels. The display area 12 may, in another example, be glass behind which are located mechanical reels. While the representation in FIG. 1 is exemplary, other slot machines may have multiple paylines or alternate means of outputting an indication of the outcome and still fall within the scope of the present invention.

Slot machine 10 further includes a handle 16. A player may initiate the movement of the reels in display area 12 by pulling on the handle 16. Alternatively, a player may initiate the movement of the reels in display area 12 by actuating the start button 18.

Slot machine 10 also includes a player-tracking mechanism, such as an identification card reader 20 into which a player may insert a player-tracking card. While illustrated as a magnetic card reader, it should be appreciated that the card reader 20 could be a smart card reader, a bar code reader, a dongle port, or other mechanism such as a wireless interrogator that interrogates a radio frequency identification (RFID) device such as a transponder positioned in a key chain fob or the like. The player-tracking mechanism may also include a display 22 (e.g., an LCD, LED display) for outputting information related to the player identifier (e.g., player's name and number of comp points associated with player's account) or other information as needed or desired.

Another dynamic display area 24 may output information to a player. The display area 24 may be utilized, for example, to inform a player that she has non-vested benefits, has qualified for a bonus round, query whether a prize package is desired (shown), or other information as needed or desired. The display area 24 may be a LCD, LED, CRT or other display mechanism as needed or desired.

The slot machine 10 may further include a payment system 26, which includes a bill acceptor 28, a coin acceptor (not shown), and/or a magnetic card reader 30. Alternatively, a smart card reader, a cashless gaming receipt acceptor, or wireless interrogator may be used if needed or desired. Players may utilize payment system 26 to establish equity in the slot machine 10 and fund wagers as is well understood. When the player provides funds, the amount appears on a credit meter 32. In an exemplary embodiment, each credit is equal to a unit of wager. More details on units of wager, coins, and credits are set forth in the Rules of Interpretation below. The credit meter 32 reflects the amount of electronic credits currently available to a player for any purpose. A player, for example, may use the electronic credits as wagers for games played on the gaming device. The electronic credits may also be "cashed out" as coins, bills, tokens, a cashless gaming receipt, and/or credits to another financial account associated with the player. In an exemplary embodiment, the credits displayed on the credit meter 32 are vested to the player, and the player may cash out such credits at any time. When the player cashes out in the form of a cashless gaming receipt, the cash value of the credits may be set forth rather than a number of credits as is well understood.

The slot machine 10 includes yet another display area 34, which displays a payout schedule of the slot machine 10. The payout schedule displays payouts that correspond to various outcomes obtainable on the slot machine 10. In one or more embodiments, if an outcome on the payline 14 corresponds to a payout as indicated in the display area 34, the credit meter 32 may increase the balance displayed by an amount of electronic credits corresponding to the payout.

The slot machine 10 further includes a hopper or coin tray 36. Payment to the player may be rendered by dispensing coins into the coin tray 36. Such coins may be dispensed based on, for example, a player's indication that the player would like to cash out his credit meter balance and/or a payout obtained by a player as a result of playing a game on the slot machine 10. Note that slot machine 10 may include different and/or additional components besides those illustrated. For example, in place of, or in addition to coin tray 36, payouts may be provided to the player through a cashless receipt, a direct deposit to a player's bank account, a credit in the player database, or the like. Note also, that a printer for printing cashless gaming receipts may also print receipts reflecting non-vested benefits associated with players.

Figure 2:
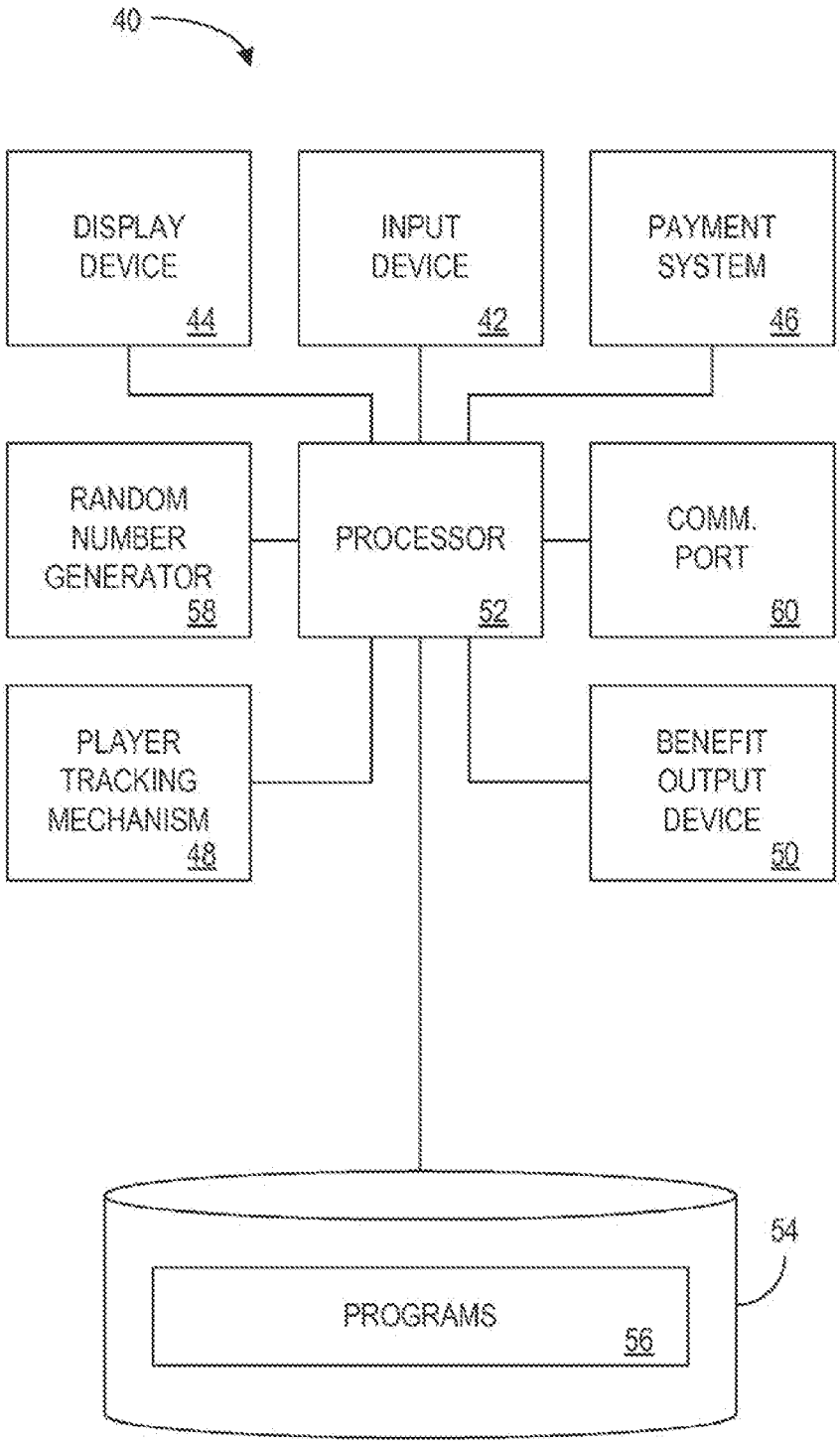
FIG. 2 illustrates a block diagram of an exemplary gaming device suitable for use with some embodiments of the present invention.

A more generic gaming device 40 is illustrated in FIG. 2. In particular, the gaming device 40 includes one or more input devices 42 (such as the handle 16 or start button 18 of FIG. 1), one or more display devices 44 (such as displays 12, 22, 32, and/or 34 of FIG. 1), a payment system 46 (such as payment system 26 of FIG. 1), a player-tracking mechanism 48 (such as card reader 20 of FIG. 1), a benefit output device 50 (such as the coin tray 36 of FIG. 1), a processor 52 associated with memory 54 having software programs 56 stored therein, a random number generator 58, and/or a communication port 60. The elements of the gaming device 40 may communicate over a wirebased bus (not shown explicitly) or wirelessly as needed or desired. Collectively, the input device 42, the display device 44, the payment system 46, the player-tracking mechanism 48, and the benefit output device 50 may be referred to as a user interface, although not all elements are required for a user interface according to embodiments of the present invention. The processor 52 may also be referred to as a controller.

The user interface may include a graphical interface through which the player operates different aspects of the gaming device 40. For example, a display device 44 may be a touch screen that includes menus and active buttons from which a player may select various options relating to her gaming experience. One such option may be supplemental audio played through speakers on the gaming device 40. The display device 44 displays a menu from which the player may select such supplemental audio. Such menus may be WINDOWS® style drop down menus that appear when a player touches a particular portion of the touch screen, selectively enabled through the actions of the player, or otherwise made available as needed or desired. Once the menu appears, the touch screen may make the menu active such that a player may make a selection from the menu by touching the area of the screen on which the option appears. While a WINDOWS® style menu option is possible, other presentations are also possible. Instead of audio, video could also be selected through such menus and then presented on one or more of the displays of the gaming device 40. As is readily understood, such a touch screen may require a touch screen controller with the menus stored in appropriate memory devices (e.g., memory 54) associated with the gaming device 40. Likewise, the content that is selected from such menus must be available either locally or remotely so that the gaming device 40 may present such content. In some embodiments, the display of such menus may preempt the display of other information. For example, in one embodiment, the menus may appear on a display 34 and, when the menus are active, the paytable illustrated in FIG. 1 may be obscured by the menus. Other arrangements are also within the scope of the present invention.

The gaming device 40 may be any appropriate gaming device such as a slot machine, video slot machine, video poker terminal, video blackjack terminal, video roulette terminal, video keno terminal, video lottery terminal, pachinko terminal, video pachinko terminal, or the like and is embodied in a housing as is well understood.

The processor 52 may be any suitable microprocessor such as an Intel® Pentium® processor or the like and may be positioned within the housing of the gaming device 40. Memory 54 may be ROM, RAM, or any other suitable computer memory device as needed or desired. Likewise, while software programs 56 are contemplated as being one way to implement embodiments of the present invention, hardwired circuitry could replace the software if needed or desired. The software programs 56 include instructions for making the processor 52 operates according to embodiments of the present invention. The software programs 56 may be stored in a compressed, non-compiled, and/or encrypted format. The software programs may include program elements that are necessary for operation of the processor such as an operating system, a database management system, device drivers, and the like. The software programs may be uploaded into the memory 54 through any appropriate mechanism such as installation from a floppy, CD, or DVD drive, downloaded from a network through communication port 60, or other mechanism as is well understood. While not explicitly illustrated, memory 54 may store a probability database and/or a payout database. The book "Winning At Slot Machines" by Jim Regan (Carol Publishing Group Edition, 1997) illustrates examples of payout and probability tables and how they may be derived. The entirety of this book is incorporated by reference herein.

The random number generator 58 (as well as any other random number generator described herein), in accordance with at least one embodiment, may generate data representing random or pseudo-random values (referred to as "random numbers" herein). The random number generator 58 may generate a random number every predetermined unit of time (e.g., every second) or in response to an initiation of a game on the gaming device 40. In the former embodiment, the generated random numbers may be used as they are generated (e.g., the random number generated at substantially the time of game initiation is used for that game) and/or stored for future use in the memory 54.

The random number generator 58, as used herein, may be embodied as a processor separate from but working in cooperation with processor 52. Alternatively, the random number generator 58 may be embodied as an algorithm, program component, or software program 56 stored in the memory 54 or other device and used to generate a random number.

Note that, although the generation or obtainment of a random number is described herein as involving the random number generator 58, other methods of determining a random number may be employed. For example, a gaming device owner or operator may obtain sets of random numbers that have been generated by another entity. HotBits™, for example, is a service that provides random numbers that have been generated by timing successive pairs of radioactive decays detected by a Geiger-Muller tube interfaced to a computer. A blower mechanism that uses physical balls with numbers thereon may be used to determine a random number by randomly selecting one of the balls and determining the number thereof.

The communication port 60 may connect the gaming device 40 to a communication network 64 (illustrated in FIGS. 3 & 4) through any appropriate communication medium and protocol. An exemplary communication port 60 is an Ethernet port that connects the gaming device 40 to an internet protocol (IP) network.

While not illustrated, some of the components of the gaming device 40 may be embodied as a peripheral device that is operatively associated with the gaming device 40. Such peripheral devices may be mounted on or positioned proximate to the housing of the gaming device 40 as needed or desired. Such peripheral devices may be particularly useful in retrofitting functionality into the gaming device 40.

Figure 3:
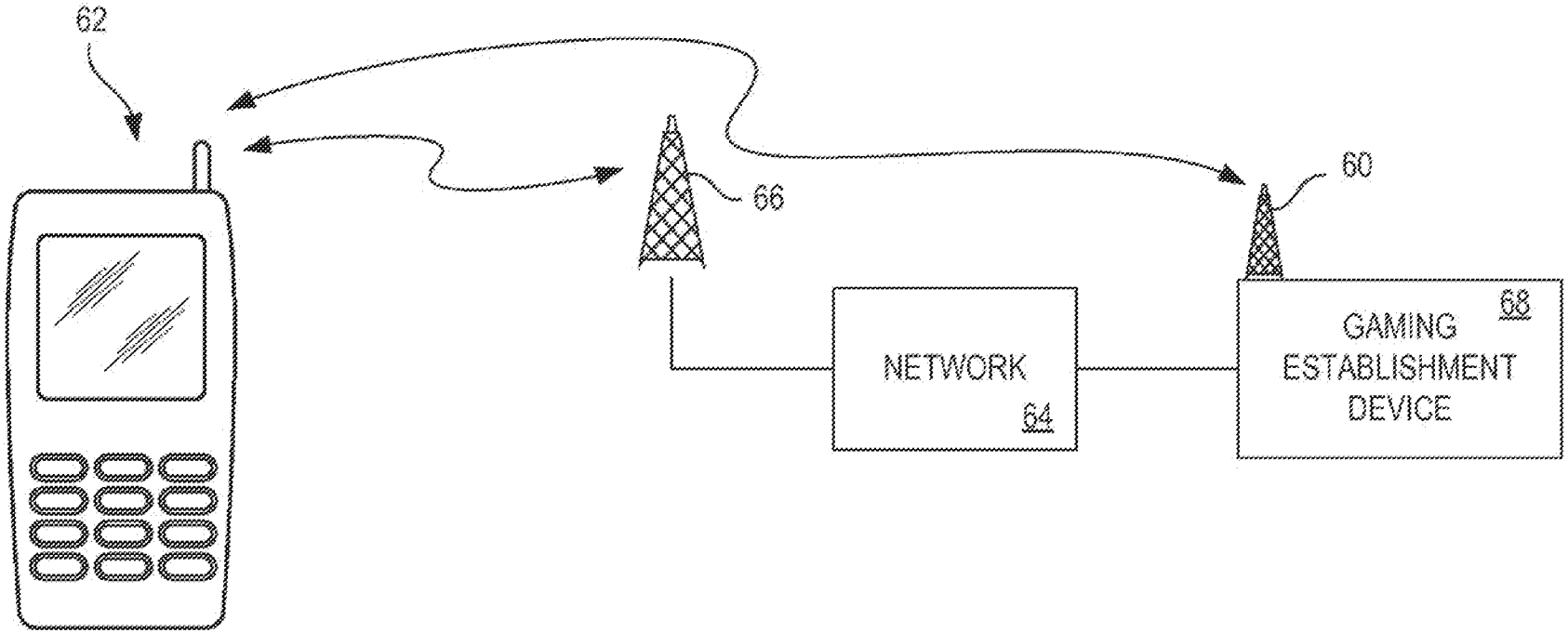
FIG. 3 illustrates a mobile terminal usable as a gaming device according to one embodiment of the present invention.

As illustrated in FIG. 3, the gaming device 40 may be a mobile terminal 62 such as a cellular telephone, a personal digital assistant (such as a PALM® or BLACKBERRY™ device), a two way pager, a portable computer, a personal computer, a personal gaming device (such as the NINTENDO® GAMEBOY™), or the like as needed or desired. The mobile terminal 62 may be a device dedicated to gambling or a multipurpose device such as a cellular phone on which games may be played as needed or desired. The mobile terminal 62 may be equipped with a user interface (keypad, display, etc.) that allows operation of a web browser (e.g., FIREFOX, MOZILLA, NETSCAPE NAVIGATOR, INTERNET EXPLORER, etc.) to interoperate with an online casino or the game may be stored locally. As yet another option, the mobile terminal 62 may instead communicate with a gaming establishment network 64 through a cellular microstation 66, and through the network 64 to a gaming establishment device 68. Alternate protocols and communication techniques could also be used such as BLUETOOTH or the like. In an alternate embodiment, the mobile terminal 62 may communicate directly with the gaming establishment device 68, such as through the communication port 60. While wireless connections are shown, it should be appreciated that the mobile terminal 62 may dock with a communication port or be connected thereto through a wire or the like if needed or desired. The gaming establishment device 68 may be a gaming device 40, a peripheral device, a dedicated interface device, or the like as needed or desired.

While it is particularly contemplated that the controller (not shown) of the mobile terminal 62 may control the mobile terminal 62, in an alternate embodiment, the processor 52 of the gaming establishment device 68 may control the mobile terminal 62. The gaming establishment device 68 may be a gaming device 40, a controller 72 (see FIG. 4), or some other device as needed or desired.

In the event that the gaming device 40 is a personal computer, the personal computer may communicate with an online casino and facilitate game play at the online casino through a modem and the internet. Other arrangements are within the scope of the present invention.

Figure 4:
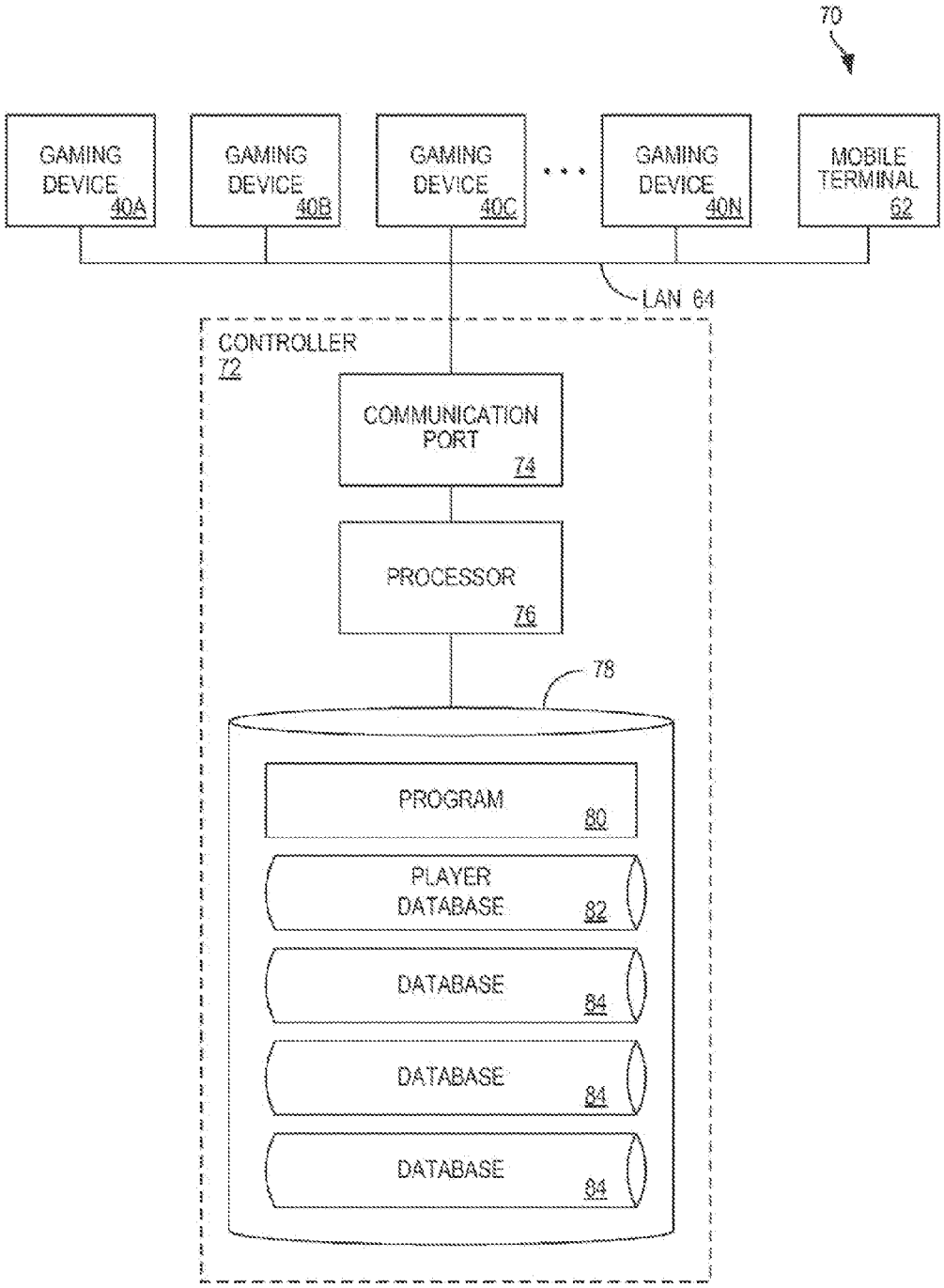
FIG. 4 illustrates a network of gaming devices with a controller according to some embodiments of the present invention.

An exemplary system 70 that is suitable for use in a gaming establishment such as a casino is illustrated in FIG. 4. In particular, system 70 shows how the gaming devices 40A, 40B, 40C . . . 40N (collectively gaming devices 40) and/or the mobile terminal 62 may be interconnected with a controller 72 through a network 64, which in an exemplary embodiment is a local area network (LAN). The network 64 may be wired or wireless as needed or desired using any appropriate protocol, although encryption may be used to protect proprietary information.

The controller 72 may perform some of the functionality previously attributed to the gaming device 40. That is, the controller 72 may act as a server and the gaming devices 40 act as client devices. The controller 72 may be a computer connected to the network 64 through a communication port 74 and operated by a processor 76. The processor 76 may interoperate with memory 78 having programs 80, a player database 82 and other databases 84 stored therein, including, but not limited to: a prize package database 130 (FIG. 6) or a prize package tracking database 170 (FIG. 8). The memory 78 may store additional databases, including, but not limited to: a game database that stores information regarding one or more games playable on and/or downloadable to one or gaming devices 40, and a scheduling and/or configuration database useful for determining which games are to be made available on which gaming devices 40 at what times. In other embodiments, some or all of these functions may be handled by a device distinct from the controller 72.

As noted elsewhere, the programs 80 may include an operating system, device drivers, and other conventional software to facilitate operation of the controller 72. While contemplated as being software, the programs 80 could instead be implemented through hardwired circuitry or a combination of the two. In place of the payout and probability databases being present in the gaming devices 40, such databases and/or data may instead be stored in the databases 84 of the memory 78. Likewise, the databases may be distributed and/or duplicated between various devices within the system 70.

The programs 80 may allow the controller 72 to track gambling, gaming or other activity performed at the gaming device 40, track gaming or other activities of individual players, instruct a gaming device to perform one or more functions (e.g., output a message to a player, interrupt play, or the like), assign or otherwise determine a unique identifier for a player, and/or control access to stored funds and/or a credit line. In some embodiments the controller 72 may be operable to configure a gaming device 40 remotely, update software stored on a gaming device 40, and/or download software or software components to a gaming device 40. For example, the controller 72 may be operable to apply a hot fix to software stored on a gaming device 40, modify a payout and/or probability table stored on a gaming device 40, and/or transmit a new version of software and/or a software component to a gaming device. The controller 72 may be programmed to perform any or all of the above functions as needed or desired. The controller 72 may be programmed to perform any or all of the functions described herein based on, for example, an occurrence of an event (e.g., a scheduled event), receiving an indication from authorized gaming establishment personnel, an authorized third party (e.g., a regulator) and/or receiving a request from a player. In other embodiments, some or all of these functions may be handled by a device distinct from the controller 72.

While the previous paragraph describes the controller 72 configuring the gaming device 40, it is also possible that the controller 72 stores games thereon, and these games are requested from the gaming device 40. The gaming device 40 may be programmed to check periodically if updates are available, and, if an update is available, download and install the update. Alternatively, the gaming device 40 may check on occurrence of an event, an indication from authorized gaming establishment personnel, an indication from an authorized third party, or the like. It is particularly contemplated that the gaming device 40 may be a thin client controlled by the server, although such is not required for operation of the present invention.

For more information about gaming devices 40, controllers 72 and other hardware and software components and their interoperation suitable for use with embodiments of the present invention, the interested reader is referred to commonly owned PCT Application Serial No. PCT/US05/043595, which is hereby incorporated by reference in its entirety.

Against this backdrop of hardware components, embodiments of the present invention are designed to incentivize longer game play by players of gaming devices 40. To this end, embodiments of the present invention modify conventional payout tables to award players with prize packages. The prize package may include a vested portion and a non-vested portion (which may include multiple sub-portions). The non-vested portion vests to the player when the player satisfies a predetermined condition. The nature of the condition may vary depending on the needs of the gaming establishment, but in exemplary embodiments, the conditions relate to continued play on the gaming device. For example, on receiving a certain outcome at a gaming device 40, the player may receive a prize package comprising five vested credits and four non-vested credits each with its own vesting condition. The first non-vested credit vests when the player completes ten additional handle pulls from the original winning handle pull; the second non-vested credit vests when the player completes twenty additional handle pulls from the original winning handle pull; the third non-vested credit vests when the player completes thirty additional handle pulls from the original winning handle pull; and the fourth non-vested credit vests when the player completes forty additional handle pulls from the original winning handle pull. In this manner, the player is incentivized to play after winning the initially vested five credits. In fact, the player is encouraged to make forty additional wagers beyond the initial wager so as to vest the final non-vested credit. In this example, each of the four non-vested credits is a non-vested sub-portion of the non-vested portion of the prize package.

Figure 5:
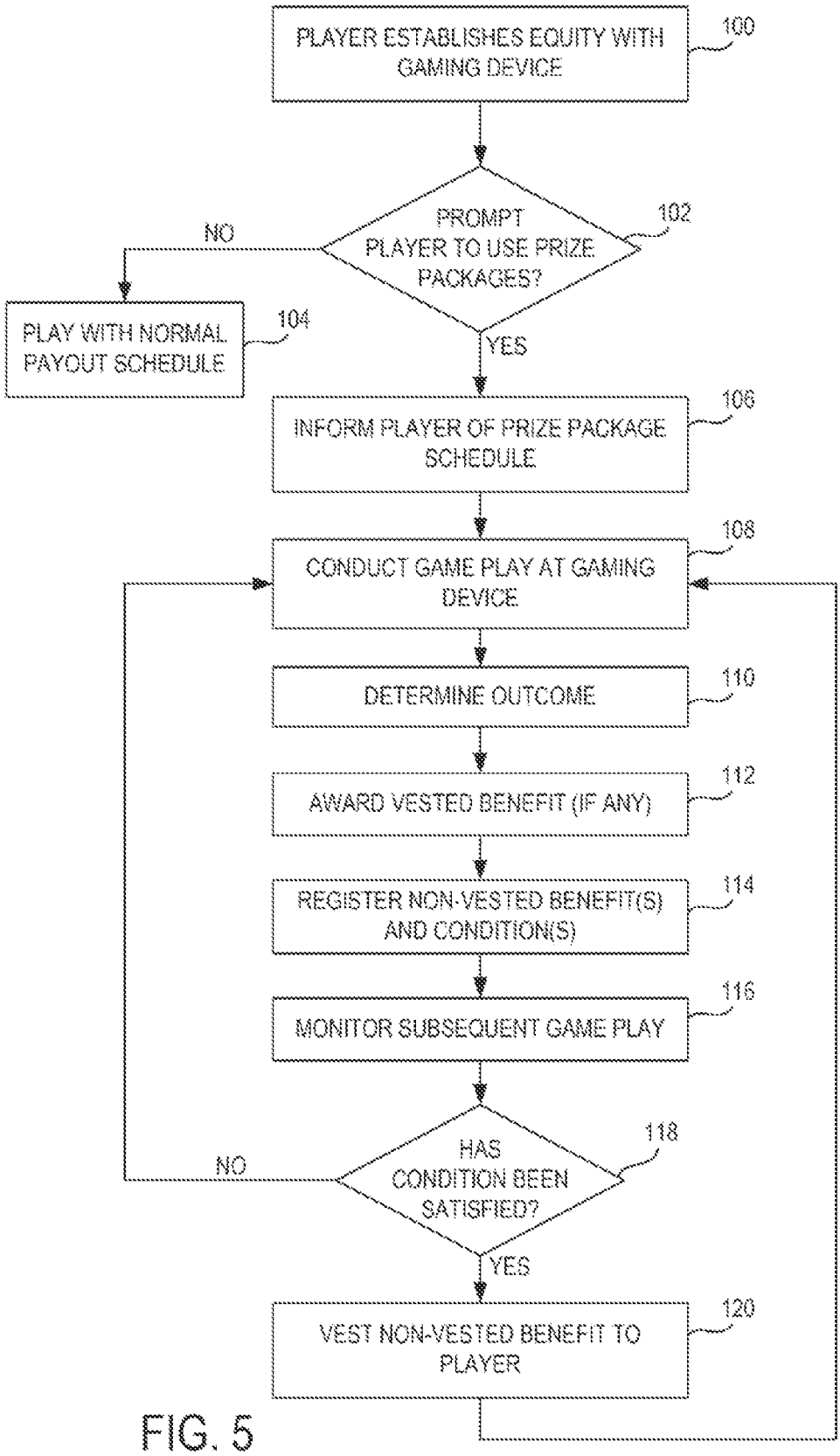
FIG. 5 illustrates a flow chart of an exemplary embodiment of the present invention.

A general flow chart of an exemplary methodology of an embodiment the present invention is presented in FIG. 5. Initially, the player establishes equity with the gaming device 40 (block 100). Establishing equity may occur by the player inserting cash into the cash acceptor 28, inserting a credit, debit, or smart card into the card reader 30, providing a cashless gaming receipt, establishing an online equity account with an online casino, linking a phone bill (or other mobile terminal access account), or the like. The player may also insert a player-tracking card or otherwise indicate who they are to the controller (whether it be processor 52, controller 72, or other controller within a gaming establishment or online casino). Such identification may make tracking the player and the player's compliance with embodiments of the present invention more readily effectuated.

The gaming device 40 may, using a display device 44, prompt the player to use the prize packages according to embodiments of the present invention (block 102). If the player declines, then play may commence using the normal payout schedule (block 104). An exemplary partial normal payout schedule is illustrated in FIG. 1 (e.g., cherry-cherry-cherry pays twenty coins for a one coin wager). However, if the player accepts, then the player may be informed of the revised prize package schedule (block 106). The revised prize package schedule can be presented on display 34 in place of the original payout schedule or through other means as needed or desired. The player may accept or decline through any appropriate input such as pressing a button, touching a touch screen, or the like. Note that the prompt and the reply are optional steps and/or may be performed later in the process.

Game play is then conducted at the gaming device (block 108). In a particularly contemplated embodiment, game play includes the player making a wager from the equity previously established and activating the gaming device 40 such as by pulling the handle 16 or pressing the start button 18. In an exemplary embodiment, the gaming establishment hosting the gaming device 40 conducts the game play. Likewise, the online casino conducts game play at the mobile terminal 62. The actual mechanics of conducting the game play may be maintained all within a particular gaming device 40, distributed between a gaming device 40 and a controller 72, distributed between a mobile terminal 62 and a controller 72, or the like, but for the purposes of the present description, all such activity is defined to be conducting game play at the gaming device.

An outcome is determined (block 110). As described above, the outcome may be determined by the processor 52, the processor 76, or the like using a random number generator 58 or other technique as is well understood. The outcome may be a losing outcome, in which case the wager made by the player is lost. Alternatively, the outcome may be a prize package that includes a vested portion and a non-vested portion that has vesting conditions under which the non-vested portion may vest to the player. In an exemplary embodiment, only if the player satisfies the condition is the non-vested portion allowed to vest to the player.

Various sorts of prize packages are described with reference to FIG. 6 below. Once the outcome is determined to include a prize package, the vested benefit (if any) is awarded to the player (block 112). The non-vested benefit(s) and condition(s) are registered to the player (block 114). This registration may include any sort of association between the player and the prize package, such as an entry in a player database 150 (see FIG. 7), an entry in a gaming device database, an entry in a payout database, storage in RAM or other memory outside of a database structure, actuation of a counter tied to track the number of game starts, or the like, and may be done concurrently with the award of the vested benefit, before or after the same. The player may then, in an exemplary embodiment, be informed of the prize package and the conditions associated therewith.

It is now appropriate to provide an example of a prize package so that the following discussion is framed against this example. In this example, the outcome cherry-cherry-cherry has the prize package with eighteen coins as the vested portion. The non-vested portion is five coins, divided into five sub-portions each with its own condition that one coin vests per ten additional handle pulls the player makes. That is, if the handle pull that achieved the present outcome is the fourth handle pull of the player's gaming session, the player is awarded eighteen coins for that fourth pull, the nineteenth coin for the fourteenth handle pull, the twentieth coin for the twenty-fourth handle pull, and so on until the twenty-third coin is awarded at fifty-fourth handle pull. The entity conducting the game play has effectively incentivized the player to make an additional fifty handle pulls to earn the non-vested portion of the original prize package.

Thus, in block 112, the eighteen coins of the vested portion are awarded. In block 114, the five coins and the one coin/ten handle pull condition are registered to the player. To ascertain whether the player satisfies the condition, the controller monitors subsequent game play by the player (block 116). During subsequent game play, the controller determines if the condition has been satisfied (block 118). If not, the process repeats as noted in FIG. 5. Note that a possible consequence is that multiple non-vested portions may be active concurrently. These may be tracked through separate entries in the player database, separate counters, or other mechanism as needed or desired. Alternatively, once a prize package has been awarded, no future prize packages may be awarded until all of the non-vested portions have vested. Normal outcomes with immediately vested payouts may still be available. Thus, instead of looping back from block 118 to block 108, the loop may be back to block 116 in this alternate embodiment.

Once the condition has been satisfied, in block 118, the controller vests the non-vested benefit (i.e., the conditional benefit) to the player (block 120). In effect, the now vested, formerly non-vested portion becomes a secondary vested portion that the player may then cash out or use as they see fit depending, in part, on the nature of the benefit provided by the secondary vested portion. In the example, once the player makes the fourteenth handle pull, the nineteenth coin is vested to the player. At the twenty-fourth handle pull, the twentieth coin is vested, and so until the entirety of the non-vested portion vests in the player.

Not shown in FIG. 5, but entirely possible is that the player discontinues play before satisfying the condition associated with the non-vested portion. For example, the player may press the button to cash out the equity; the player may exhaust their equity; or the player may simply walk away from the gaming device 40 (although this may be unlikely so long as equity remains). One of several options exists at this time. As a first option, the player forfeits the non-vested portion. That is, the non-vested portion terminates, and the player is no longer eligible to earn the non-vested portion. In practice, any non-vested portions that have been associated with the player as a function of the registering step (block 114) are now deassociated from the player such that the player is no longer eligible to receive the non-vested portion.

As a second option, a pro-rated version of the non-vested portion is awarded to a player. For example, if the vested portion was ten coins and the non-vested portions were five coins to be paid every fifty additional handle pulls for two hundred handle pulls (i.e., an extra twenty coins for two hundred extra handle pulls), but the player discontinues play after twenty additional handle pulls, then the player may only be awarded two extra coins from the non-vested portion.

As a third option, the non-vested portion may have an expiration date. For example, the player has one hour, one day, one week, or one year from the handle pull that generated the prize package to complete the condition. After the time period expires, if the player still has not completed the condition, the non-vested portion terminates. Tracking the player over this time frame may be done by way of a player-tracking card, cashless gaming receipts, or other similar mechanism. This option may allow players greater flexibility in meeting the condition, in turn making the players happier and/or building brand loyalty. Likewise, if the player leaves the gaming establishment with non-vested portions still pending, the player may be more likely to return so as to vest the non-vested portions.

As still another alternative, a condition may include a time frame, but when the time frame passes, the condition is not deassociated from the player. For example, if the condition states that twenty handle pulls must be performed by 10:00 PM, Jun. 1, 2006, but the player has only made six handle pulls, and the time is now 11:00 AM, Jun. 3, 2006, then the condition can never be satisfied. Such lapsed conditions may be carried on the registers or in the databases even though there is no possibility of vesting the non-vested portion. As a matter of database management, it may be simpler to eliminate such lapsed non-vested portions. Still other options are possible as needed or desired.

Figure 11:
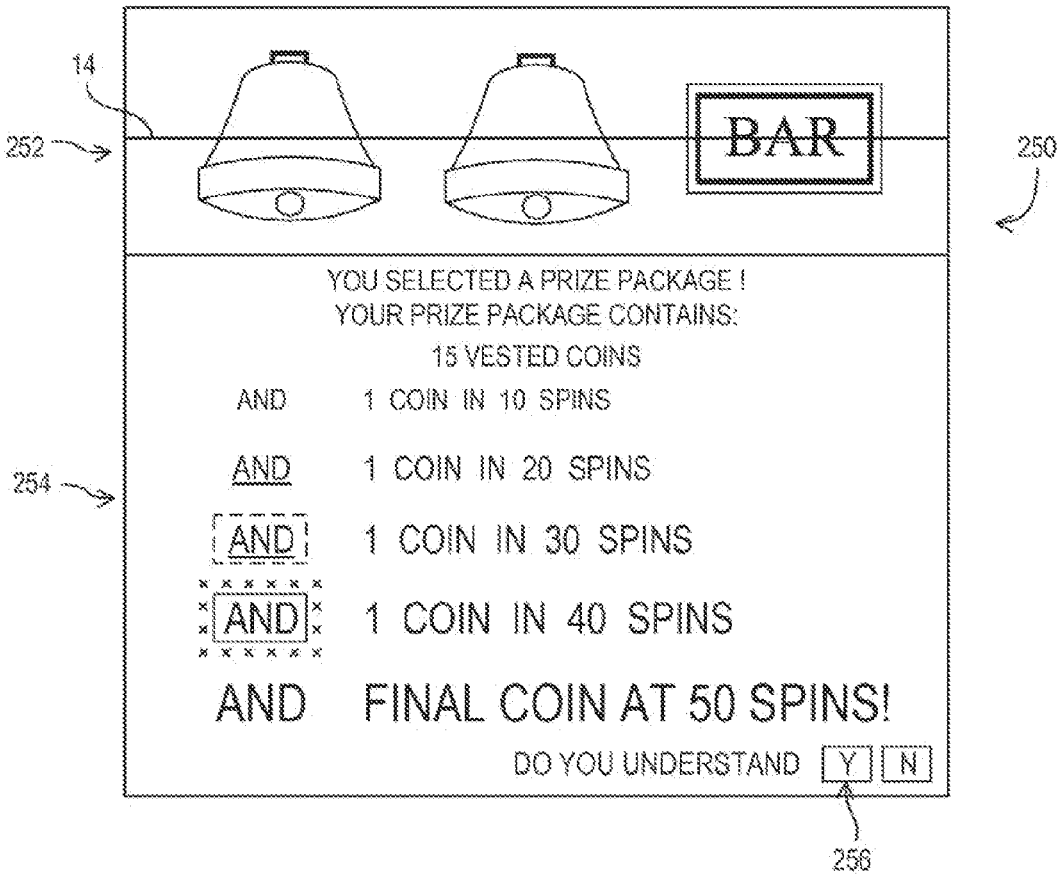
FIG. 11 illustrates an exemplary screen shot of a prize package being presented to a player after an outcome.

As noted above, querying the player and receiving the response about whether the player desires a prize package is an optional step, and its timing may be varied. In an alternate embodiment, instead of querying whether the player would like to play with prize packages enabled (block 102) after the player establishes equity (block 100), the controller may query the player after the outcome is determined. That is, play begins as normal, and only after an outcome with a prize package is determined is the player queried if she wants a prize package or a normal payout. For example, upon receiving an outcome bell-bell-bar, one or more of the display devices 44 may be used to query the player whether she would like eighteen coins now or a prize package with fifteen coins vested now and one non-vested coin for each ten spins up to five extra coins (see FIG. 1 and FIG. 11). Players may select an option depending on their anticipated future behavior. Thus, if a player knows she is about to leave the machine, she may opt for the traditional immediate payout rather than accept a prize package with a non-vested portion.

As a variant embodiment, a player may be provided the opportunity to choose between two or more different prize packages with different non-vested portions and/or different conditions. Players may then pick the prize packages with conditions that more closely match their expected play patterns. As the different prize packages are linked to a particular outcome, it may make more sense to the player to make the query proximate in time to the outcome.

As another embodiment, the gaming device 40 may not give the player the choice of using prize packages. Rather, simply by choosing to play at that particular gaming device 40, the player implicitly consents to play with prize packages enabled. In a first embodiment, every winning outcome is associated with a prize package having vested and non-vested portions. In a second embodiment, only some winning outcomes are associated with prize packages having vested and non-vested portions. Other winning outcomes have only vested portions and still other winning outcomes have only non-vested portions.

As still another embodiment, the gaming device may selectively require use of prize packages. For example, geyser-geyser-geyser on an "Old Faithful" machine always results in a prize package, but other outcomes such as geyser-cherry-cherry give the player a choice of a vested package or a prize package. Permutations of these myriad options of mixing prize packages with more traditional outcomes are within the scope of the present invention.

As still another embodiment, the query may be implied rather than explicit. For example, the player may be asked to select a paytable from a menu. At least one paytable on the menu includes prize packages. Still another variant embodiment is a command (perhaps on a drop down menu or the like) that requests a change in paytables, and when activated, the player is presented a choice of paytables, at least one of which includes prize packages. Still another variant is a command issued by the player to play with prize packages. This command may be made a priori such as in a player-tracking database preferences table, or be a selectively acuatable element (e.g., a button, area on touch screen, switch, handle, or the like) that the player uses. The presence of such an element is an implicit query to the player about how she wishes to configure the paytable and whether she wishes to play with prize packages enabled. Other implicit queries may also be arranged as needed or desired.

As illustrated in FIG. 6, the various prize packages and conditions may be stored in a prize package database 130, which may be stored in the gaming device 40, in the controller 72, or other location as needed or desired. Prize package database 130 may include a prize package ID field 132, which has a unique identifier for each prize package, and a contents of prize package field 134 in which the vested portion, the non-vested portion and the conditions are stored. In the example illustrated, PKG-002 has a vested portion 136 of twenty coins, and a non-vested portion 138 of thirty coins, split into three sub-portions of ten coins for every fifty spins. As is readily apparent from the examples provided in the prize package database 130, some prize packages have no vested portion (PKG-001) or large, non-zero value vested portions (PKG-002) with other vested portions having values in between. From a particularly contemplated accounting point of view, the non-vested portions have a zero value until vesting, although other viewpoints may ascribe a value to the non-vested portions differently.

While many of the examples above have tied the condition to handle pulls, it should be appreciated that such a non-vested portion need not be tied to a slot machine embodiment. Rather, the handle pull may be abstracted to game starts (hands of poker, spins of roulette wheel, etc.) according to the nature of the gaming device 40.

As intimated by the examples provided in FIG. 6, various sorts of conditions are contemplated and within the scope of the present invention. For example, various conditions that may be imposed include, but are not limited to: a number of game starts (or outcomes) since the prize package was registered to the player (i.e., conducting a predefined number of additional game plays); number of game starts (or outcomes) since some other event (e.g., since the start of the gaming session); maintaining game play until a certain time; maintaining game play for a predetermined period of time; maintaining a rate of play for a predetermined period of time (which is functionally equivalent to requiring a certain number of handle pulls within a certain amount of time); player receives a number of consecutive losses; player receives a number of consecutive wins; player plays during a certain time of day; player plays on a certain day of the week; player wagers a certain amount (a non-vested sub-portion vests for every ten coins wagered by the player); player deposits a certain amount of money in the gaming device 40; player achieves a certain credit balance on the gaming device 40; player loses a certain number of credits; player wins a certain number of credits; the player achieves a certain outcome (e.g., lemon-lemon-grape, 19 in video blackjack); an outcome includes a certain symbol (e.g., in video poker, one eyed jack vests a non-vested sub-portion); player achieves a certain number of consecutive outcomes; player has a net outcome above/below a predetermined threshold over a series of game starts (e.g., player has ten outcomes in a row with a total payout of less than five coins); player has a series of outcomes each of which is below a certain threshold (e.g., player has ten outcomes in row, each with a payout of less than five coins); player earns a certain number of comp points; player completes a task for a third party (e.g., completes a survey from the gaming establishment, establishes a bank account with a preferred bank, applies for a credit card from a preferred provider, etc.); and the like. Some conditions may not be satisfied by the player, but rather by a third party. For example, a condition may be that associated gaming devices have one hundred game starts or a spouse's player-tracking record must reflect twenty game starts. Conditions do not have to be single or conjunctive conditions, but rather could be listed in the alternative. For example, a sub-portion may vest when a player receives a cherry-cherry-cherry OR on the one hundredth spin, whichever comes first. Conditions may be set forth as a mathematical expression (perhaps Boolean or algebraic) as needed or desired.

Likewise, there are myriad forms that the non-vested portions or sub-portions may take. For example, other possible prize packages include, but are not limited to: one credit every third spin for the next thirty spins for a total of ten non-vested credits; four credits on the tenth, twentieth, and thirtieth spins after the wining outcome; two credits continuously per minute for the next ten minutes (so long as the player maintains a rate of play of at least five spins/minute); two credits for every credit deposited into the machine during the next five minutes (up to a maximum of forty credits); fifteen coins after completing fifty more spins; twenty coins vested, with ten coins every fifty spins, up to a maximum of thirty coins; three coins as a consolation prize after next four consecutive losses; seven coins vested, with three coins as a consolation prize after the next four consecutive losses; five coins every minute for the next five minutes (twenty-five coins total); thirty coins at the end of the hour; one coin for every coin deposited into the gaming device 40 during the next ten minutes (maximum of twenty coins awarded); six coins vested, and two coins for every twenty coins wagered on the gaming device 40, up to a maximum of eighteen coins; one coin per minute up to twenty minutes; and the like.

Note that some embodiments of the non-vested portions may have an implicit condition that the player has to make at least one more play to start the vesting. For example, for non-vested portions that provide a continuous payout for a predetermined period of time, the first incremental vesting may wait until the player begins play. Likewise, monitoring the player may be continuous in many instances to determine that the player is continuously meeting the condition (especially for those embodiments where a rate of play is part of a condition). Thus, in some prize packages, there is no vested portion and there is only a non-vested portion(s) and condition(s). Further, the terms of the prize package may limit (explicitly or implicitly) the total value of the non-vested portion. That is, any possible payout that eventually vests from the non-vested portion may have a maximum value. For example, the player wins a maximum number of credits, no matter how often the condition occurs; there are a maximum number of non-vested sub-portions; there is a time limit on how long the non-vested portions continue to vest; or the like as needed or desired.

In still other embodiments, the non-vested portion may not be a credit or coin, but rather is some other benefit. For example, the non-vested portion could be a ticket to a buffet, a coupon for a meal in the gaming establishment, a ticket to a show, a free spin, or an intra-game benefit. Exemplary intra-game benefits include, but are not limited to: activating at least one additional payline, increasing a payout amount for at least one achievable outcome (e.g., doubling the jackpot), allowing bonus game access for reduced wagers, reducing a maximum wager amount, increasing a maximum wager amount, increasing a frequency associated with entering a bonus game, increasing a likelihood associated with entering a bonus game, altering odds of achieving certain outcomes (e.g., chance of jackpot goes from one in 10648 to one in 10647), altering whether certain outcomes qualify as payout events (e.g., ace-high wins in video poker instead of usual pair or better rule), and the like.

While the prize package database 130 shows only a few prize packages, some or all of the exemplary prize packages may be included in an implemented database. Likewise, the prize package database 130 could split the vested portion, non-vested portion, and the condition associated with each sub-portion into separate fields if needed or desired. The database 130 may further have a field (not shown) that shows which outcome of a particular game on a gaming device 40 results in a particular prize package. Note that other file structures besides databases are also possible such as a hierarchical file structure. Additionally, the location of the database or storage of prize package information may be varied to be on the gaming device 40, at the controller 72, distributed between the two or otherwise arranged as needed or desired.

While it is expected that each prize package may be ascribed to a particular outcome available in the gaming device 40 (e.g., cherry-cherry-bar is always PKG-001), such is not required. Rather, the awarding of prize packages may be varied between outcomes based on a number of factors. For example, player behavior could be detected, and, if the player's rate of play slows in a manner perhaps indicative of incipient cashing out, a prize package could be offered to incentivize the player to stay at the gaming device. More information on detecting player behavior can be found in commonly owned U.S. patent application Ser. No. 11/422,376 filed 6 Jun. 2006, which is hereby incorporated by reference in its entirety as well as the previously incorporated '595 PCT Application. While those applications focus on detecting problem gambling, the sensor suites described therein could readily be adapted for use with the present invention. Likewise, prize packages could be dynamically assigned as outcomes based on other outcomes obtained by the player. For example, if the player has a string of non-winning outcomes, a prize package could be offered to induce the player to continue playing. Other factors may also be used if needed or desired.

When a prize package is associated with a player, the association may be stored in the player database. FIG. 7 illustrates an exemplary player database 150 (which is an exemplary embodiment of player database 82 (FIG. 4)) such as may track the current status of the various prize packages relative to the players. The player database 150 includes a player identifier field 152, which may be a unique identifier for each player in the player database 150; a name field 154, which may be a name for the player as was submitted by the player; an address field 156, which may be the address provided by the player as a means of contacting the player; a player since field 158, which may have the date on which the player signed up for the player-tracking program; a total wager field 160, which includes the total wagers made by the player since a particular date; an eligible for prize package field 162, which may indicate whether a player has qualified for prize packages, as may be desirable in accordance with some embodiments of the present invention; a theoretical win field 164, which includes an expected profit to the gaming establishment from the player based on her wagers; a prize package preference field 166, in which the player may have stated whether she prefers to be offered prize packages in accordance with embodiments of the present invention; and a prize package active field 168, which lists any prize packages (such as by the prize package identifier from database 130) currently active (e.g., which contain non-vested portions) for the player. Other information may be stored in the player database 150 as needed or desired (such as hotel guest status, problem gambler status, drink preference, and the like).

For players that are not members of a player-tracking program, temporary entries may be created in the player database 150 with as much information as is necessary and sufficient to track the player relative to any prize packages (gaming device identifier for the game on which the prize package was awarded, playing since what time, and the like), or a separate database may be created. As still another option, players who are not members of the player-tracking program may not be eligible to receive prize packages.

For gaming establishments that do not wish to clutter their player database 150 with prize package information, do not have player databases 150, do not have a substantial percentage of their players registered for a player database 150, or do not have gaming devices 40 integrated into a gaming device server (e.g., controller 72), prize package information may be stored locally at the gaming device 40 that has awarded the prize package. Still other reasons may exist for keeping the prize package information separate from the player database 150. It is not critical to the present invention that a player database 150 be used. Rather, the player database 150 makes a convenient facilitator for associating one or more prize packages with players.

Tracking of prize packages may be done in a separate database 170 (illustrated in FIG. 8) or as part of the player database 150. As illustrated in FIG. 8, the database 170 includes a player ID field 172, a prize package ID field 174, a non-vested sub-portion ID field 176, a sub-portion value field 178, a vesting event (or condition) field 180, and a paid flag 182. The player ID field 172 and prize package ID field 174 may include identifiers from the player database 150 and/or the prize package database 130 as needed or desired.

For those prize packages with non-vested sub-portions, each sub-portion may be listed separately in the non-vested sub-portion ID field 176 along with a value and a condition in fields 178 and 180 respectively. The vesting event field 180 illustrates how counters may be used to track when a non-vested event should be vested. In the particular examples, a spin counter associated with a player may be maintained starting at one when the player initiates the first game play. Each time the player initiates game play, the spin counter is incremented. When the spin counter reaches the value identified in the vesting event field 180, the non-vested sub-portion vests. Likewise, a loss-counter, win-counter (not shown), wager counter, balance counter, and the like could all be used depending on the conditions set forth for vesting. The paid flag 182 represents whether a particular sub-portion has vested or not. In place of counters, other techniques may be used as needed or desired.

In an exemplary embodiment, before the player is offered the choice of playing with prize packages, the controller 72 (or other controller as needed or desired) may determine if the player is eligible to play with prize packages. Such determination may be made by reference to eligible for prize package field 162, which in turn may be populated according to a number of different factors. For example, prize packages may only be offered to players who have joined a player-tracking program or players that have achieved a certain comp level. Still other variables include, but are not limited to: the identity of the player, player history, player hotel guest status, player preferences (e.g., if the player says he does not want prize packages, then he may not qualify or is ineligible for prize packages), the status of a player-tracking card (inserted/not inserted) or other player-tracking mechanism, value of the player's current equity in the gaming device 40, and the like. These variables are generally under the control of the player. Other variables may also be considered which are not under the control of the player. Such external variables may include, but are not limited to: date, time of day, day of week, weather, contemporaneous sporting event information, gaming device utilization within the gaming establishment (e.g., if under 50% of the gaming devices are being utilized, offer the prize package), historical usage of that particular gaming device, and the like.

As yet another variation of the present invention, instead of checking to see if players qualify for prize packages, the default rule may be the utilization of prize packages according to embodiments of the present invention, and the controller checks to see if the player qualifies for play without prize packages. The variables used to determine whether a player qualifies for play without prize packages may be those listed above for the converse situation or other variables as needed or desired. As still another variant, qualification for utilization of prize packages may be omitted or determined by a player's willingness to use a particular type or style of gaming device 40. For example, sitting at a JOKERS WILD video poker machine may qualify a player to utilize the prize packages on that JOKERS WILD machine.

As another option for the present invention, the conditions under which non-vested portions vest may be updated dynamically within the prize package database 130. For example, if, after securing empirical data that there is a high rate of non-vested portions being terminated, the controller 72 (or other controller or processor as needed or desired) may modify the condition to make it easier for the non-vested portions to vest. Likewise, if empirical data indicates that no or few players are accepting or selecting the prize packages, then the conditions or the non-vested portions may be varied to attempt to lure players into choosing the prize packages. Conversely, if the prize packages are being oversubscribed, then the conditions or portions may be varied to reduce the likelihood that a player will accept a particular prize package. In one exemplary embodiment, it is possible that a particular condition is more likely to cause a player to choose the prize package regardless of the perceived value of the non-vested portion. In such an instance, that condition may be used for multiple prize packages. Alternatively, players may be discouraged from not choosing prize packages (e.g., every time a player declines a prize package opportunity, pestiferous audible signals are emitted).

As discussed above, most non-vested portions are presumed to have a maximum potential value or cap, which limits how much the player may ever secure through satisfaction of conditions. In effect, these maximum values or caps allow the gaming establishment to delineate maximum potential obligations to players. This delineation may, in turn, help the gaming establishment create a paytable, which has a desired hold percentage. As an alternate embodiment, the non-vested portion may continue to vest incrementally until a termination event or symbol occurs. For example, the player may get one coin per ten handle pulls until either the player cashes out or the player receives a lemon symbol on a reel. Other termination events may be as varied as the conditions under which the non-vested portions vest. Implicit in the above example is that there may be multiple termination conditions (e.g., one-eyed jacks, suicide kings and the ace of spades in video poker all may signify a termination event for a single prize package).

A permutation of the termination event is a partial termination event that reduces the non-vested portion. That is, only some of the non-vested sub-portions may be terminated upon occurrence of certain events. These are sometimes referred to herein as second conditions. Such partial termination events may be as varied as the termination or vesting conditions. For example, the appearance of a lemon on the payline 14 of the slot machine 10 may result in a single non-vested sub-portion being terminated. Two lemons terminate two non-vested sub-portions, and so on. Other symbols could be used for other games or as needed or desired. Or perhaps, the reappearance of an outcome that provided the prize package before vesting of the non-vested sub-portions causes one or more non-vested sub-portions to terminate. To ease the perceived pain of a terminating event, either partial or full, a consolation prize may be offered. Such consolation prizes could be pro-rated versions of the non-vested sub-portion that was just terminated, coupon(s), meal tickets, show tickets, a free spin, comp points, credits, a tee-shirt, or the like as needed or desired. While the examples provided above refer to termination of non-vested portions, other partial terminations are contemplated, including, but not limited to: reducing a payout for a non-vested sub-portion(s) by a predetermined percentage (e.g. 50%).

As another possible permutation, the vesting conditions may vary dynamically based on secondary conditions. In one embodiment, subsequent game outcomes may accelerate a vesting schedule. For example, a cherry-cherry-lemon outcome may cause the next due non-vested sub-portion to vest immediately rather than wait until the normal condition is satisfied. As a variation, such acceleration may take the place of a second prize package. Returning to the cherry-cherry-cherry example listed above. If, on the fourth spin, the player receives another cherry-cherry-cherry outcome, instead of another prize package, the player may immediately vest the next two non-vested sub-portions. Alternatively, some outcomes may delay the vesting of non-vested portions. For example, a lemon-lemon-lemon outcome may add five spins to the vesting condition such that the vesting of a non-vested sub-portion is delayed. As another example, the player may pay to accelerate the vesting schedule. As yet another example, if usage of the gaming devices within the gaming establishment is high, then the vesting schedule may be shortened so that gaming devices have high turn over rates to make the machines available to more players. Other acceleration or deceleration factors include, but are not limited to: an outcome of a bonus game, use of a preferred gaming device, use of a preferred player-tracking mechanism (e.g., accelerate wireless transponder player-tracking mechanisms and decelerate magnetic card player-tracking mechanisms so as to incentivize use of the transponder mechanisms), historical utilization of the gaming device, utilization levels of other gaming devices within the gaming establishment, use of the gaming device by the player to purchase an ancillary product, activity by a second player, redemption of comp points, and the like. Still other factors may accelerate or decelerate vesting schedules as needed or desired.

As another variation on the acceleration of the vesting, a super-vesting condition could be used to incentivize players to accept prize packages. For example, a subsequent outcome could cause all non-vested benefits to vest at double their stated benefit for a predetermined time or a predetermined number of game starts. Again, the conditions that trigger such a super-vesting mode are as varied as the conditions which accelerate vesting or decelerate vesting.

While the prize package has been expressed in terms of coins or credits, it should be appreciated that other benefits may be provided as part of either the vested portion or the non-vested portion(s). In the simplest embodiment, when a non-vested portion vests, the vested value is simply added to the player's credit balance on the gaming device. In a second embodiment, personnel from the gaming establishment may visit the player at the gaming device with a check or gift certificate for the value of the now vested non-vested portion. In another embodiment, intra-game benefits may be provided. For example, additional paylines may be activated on the gaming device, the payout schedule may be varied to a more favorable payout schedule, the odds of a particular outcome are changed, the definition of a winning outcome may change (Ace-high hand may win in poker), or the like.

While the examples above all focus on providing the non-vested portions to the player whose outcome resulted in the original prize package, the invention is not so limited. For example, the non-vested portion may vest to a player on a second gaming device. In one example, the sub-portion may vest to a player's spouse or associated player. In another example, the sub-portion may vest to a player at a random gaming device. Other possibilities are within the scope of the present invention. Note that it is possible that the vesting to a player at a second gaming device vests an intra-game benefit to the player at the second gaming device, where the intra-game benefits are analogous to those already described. Also note that because gaming devices may occur in different denominations, such non-vested portions may have to be translated from a first potential value associated with the first gaming device to a second potential value at the second gaming device. For example, if the first person is playing on a dollar slot machine and has a prize package that pays three coins (three dollars) at the tenth spin to a spouse at a quarter slot machine, the spouse, after ten spins, receives three dollars (or for her, twelve coins). Alternatively, the gaming establishment may decide that a credit on one machine is a credit on a second machine regardless of whether there is a difference in value between the two credits.

Figure 9:
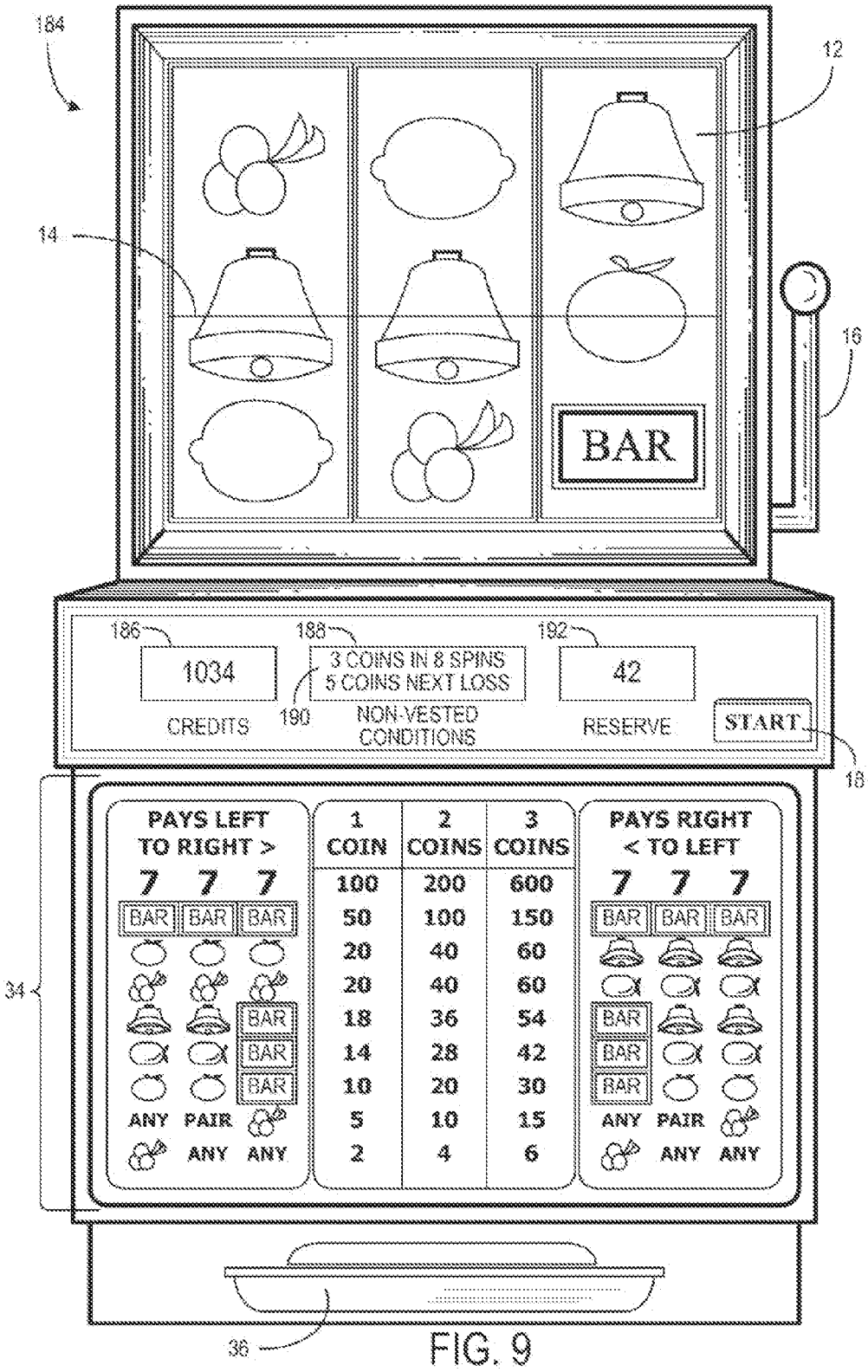
FIG. 9 illustrates an alternate gaming device with multiple credit meters according to one embodiment of the present invention to track different balances for the player.

As the concepts of prize packages with various vesting conditions may be confusing to players, embodiments of the present invention also contemplate alternate ways to present the information to the players. For example, an alternate slot machine 184 is illustrated in FIG. 9. Many of the elements of slot machine 184 are similar to those of slot machine 10, but the display devices have been rearranged and repurposed. A credit meter 186 shows a balance currently vested to the player (e.g., 1034 credits). This balance may be the result of coin-in on the part of the player, winning outcomes from the slot machine, secondary vested portions earned by the player, and the like minus any wagers or purchases made by the player. The player may redeem this value in full if the player elects to cash out. Redemption can, as noted elsewhere, be through cash, through a cashless receipt, or other technique as is well understood.

A second meter 188 lists through indicia 190 non-vested portions and conditions under which the non-vested portions will vest (e.g., three coins in eight spins and five coins on the next loss by the player). As multiple non-vested portions and conditions may exist concurrently, this second meter 188 may scroll or otherwise dynamically update to reflect the changing requirements to vest non-vested portions. Another embodiment of the second meter 188 is an hourglass, wherein the granules of sand in the top portion are metaphors for the non-vested sub-portions that trickle into the bottom portion as the vesting conditions are satisfied.

A third meter 190 entitled the reserve meter refers to a concept introduced in U.S. Patent Application Publication No. 2003/0199312, which is hereby incorporated by reference in its entirety. That application discloses, inter alia, that a gaming device 40 may be configured to store (hidden or secretly in most embodiments) a portion of a player's credit balance in an account that is not displayed on the credit meter of the gaming device. For example, a very small portion of a player's winning outcomes may be stored in the hidden account, and this amount in the hidden account may be used to fund a bonus prize that is provided to the player, change an outcome from a losing outcome to a winning outcome, increase a winning outcome, or the like. The third meter 190 removes the hidden aspect of the '312 publication and presents the value of this reserve account (e.g., forty-two credits). As noted in the '312 publication, limits may be placed on when and how the player may redeem these reserve amounts, but these reserve amounts are considered vested in context of the present invention.

As a variation, display devices 44 may be made larger and more information presented to the player, perhaps through a WINDOWS-like user interface. For example, in FIG. 11, a screen shot of an explanation screen 250 for a prize package is presented. A first portion 252 of the screen has a reproduction of payline 14 so that the player may see the outcome in question. A second portion 254 of the screen has explanatory text and/or images to help explain the prize package and the conditions. Note that the text and images may become more gaudy and/or eye-catching in the later occurring non-vested portions so that the players are tantalized into believing these later portions are desirable. In an exemplary embodiment, an optional query indicia 256 is provided asking the player whether they understand. The player may respond affirmatively or negatively by touching a touch screen, pressing a button, or the like as needed or desired. If the query is answered negatively, further explanations may be provided (e.g., perhaps with a video clip demonstration) or gaming establishment personnel may be directed to visit the player and answer questions. Note that the portions 252, 254 may be in a single display device 44 or separate as needed or desired.

Figure 12:
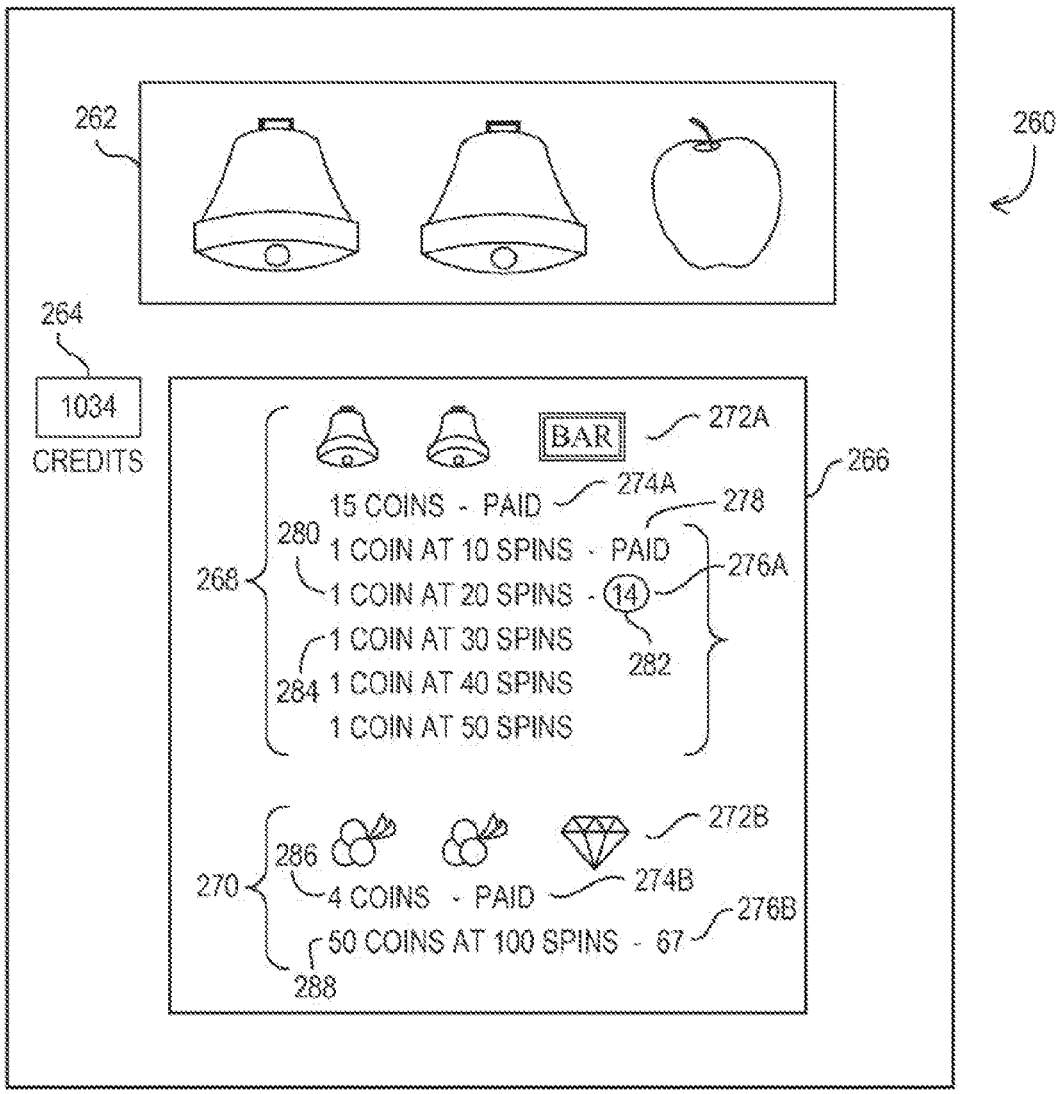
FIG. 12 illustrates an exemplary screen shot of a more detailed prize package-tracking meter.

In place of the second meter 188 of FIG. 9, a more complex meter may be presented as illustrated by screen shot 260 in FIG. 12. A current outcome 262 is presented in the display along with a credit meter 264. However, in place of the second meter 188, a tracking meter 266 is displayed. The tracking meter 266 includes, in this example, a first prize package 268 and a second prize package 270. Each prize package 268, 270 includes indicia 272A, 272B relating to the outcome that generated the prize package, vested indicia 274A, 274B, about what portion of the prize package was vested, and non-vested indicia 276A, 276B, about what portion of the prize package was not initially vested.

Within the non-vested indicia 276A, each condition is listed along with a status relating to the condition. For example, line 278 shows that the first non-vested subportion has been paid, whereas line 280 shows a counter 282 that shows the player is fourteen spins towards the twenty required to vested the second non-vested subportion. The counter 282 declaring fourteen may increment with each game start of the player and may be repositioned on the third line 284 when the player reaches twenty spins and the second non-vested subportion is paid.

Likewise, within the non-vested indicia 276B, the line 286 reflects that the vested portion has been paid, while line 288 shows that the non-vested portion is sixty-seven spins into a hundred spin count to vest the non-vested portion.

While FIG. 12 shows one exemplary screen shot, those skilled in the art will recognize that variations on the location and depth of information provided are within the scope of the present invention.

Figure 10:
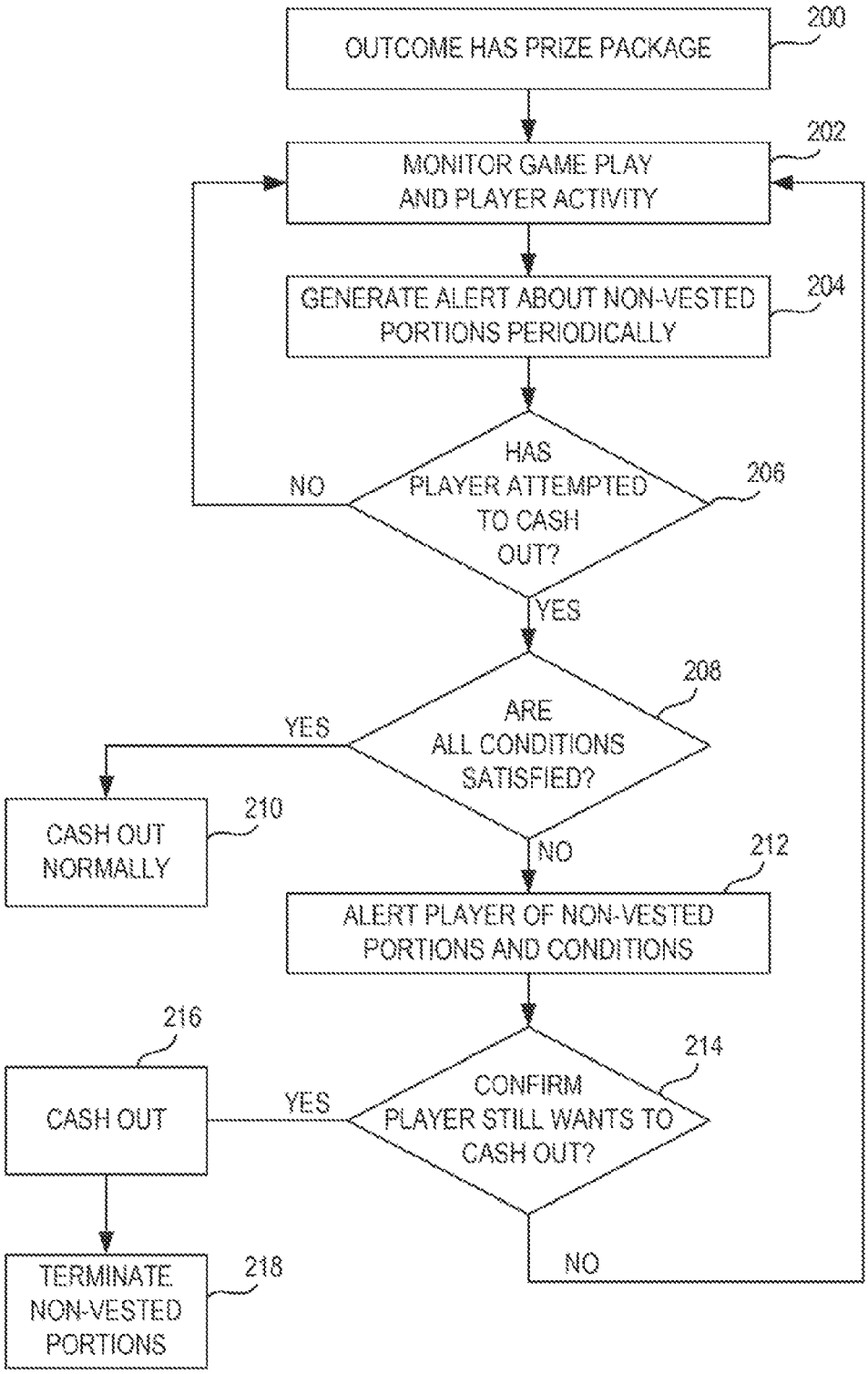
FIG. 10 illustrates a flow chart of an alternate embodiment of the present invention wherein players are reminded about non-vested portions of prize packages.

Another embodiment of the present invention is designed to further encourage players to vest all the non-vested sub-portions. To this end, this embodiment is designed to subtly encourage players not to cash out before the conditions of the non-vested portions have been satisfied. An exemplary flow chart is illustrated in FIG. 10. The process begins as previously described with the player establishing equity and the conductance of game play. Eventually, the player receives an outcome that has a prize package (block 200). The controller monitors game play and player activity (block 202). As discussed herein, monitoring player activity may be to detect whether the player appears restless or about to cash out. An alert will be generated about the non-vested portions still associated with the player (block 204). Such alerts may be audible or appear on a display device 44 or the like as needed or desired. Such alerts may remind the player that they have a vesting event in a certain number of spins or the like. While it is contemplated that such alerts are generated periodically (e.g., every twenty spins), player activity or thresholds until vesting (e.g., "only five more spins until five coins vest from your earlier prize package!") may also trigger such alerts. Such alerts are optional, but by reminding the player that non-vested portions remain, it is likely that the players will be incentivized to stay at the gaming device and continue playing.

The controller also monitors the gaming device to detect if the player attempts to cash out (block 206). If the answer is no, monitoring continues. If, however, the answer to block 206 is yes, the player has attempted to cash out, then the controller determines if all the conditions for the non-vested portions have been satisfied (block 208) such that the player has no non-vested portions remaining associated with the player. If the answer is yes, the player has satisfied all conditions, then the gaming device 40 may allow the cash out to proceed normally (block 210) and provide the player with all her vested winnings.

If, however, the answer to block 208 is no, there are still unsatisfied conditions, then the gaming device 40 may alert the player of the non-vested portions and the conditions under which vesting can be achieved (block 212). Such an alert may be visual or audible as needed or desired. In addition, the gaming device 40 may confirm with the player that the player still wants to cash out in light of the non-vested portions remaining (block 214). If the player then declines to cash out, play resumes and the player is monitored as before.

If, however, the player confirms that she wishes to cash out, then the cash out proceeds (block 216) and the non-vested portions associated with the player are terminated (block 218) if appropriate.

As a variation on terminating the non-vested portions if the condition is not satisfied, an alternate embodiment of the present invention allows the player to trade the expectancy of the non-vested portions for value. In a first embodiment, the trade may be for a pro-rated amount of the non-vested portion. For example, if the player has made twenty of fifty spins, but has to leave to go see a show, the player may request to receive forty percent of the next non-vested sub-portion. In a second embodiment, the trade may be for an ancillary benefit, such as adding to the player's comp point total, a coupon for a vendor within the gaming establishment, a coupon for a vendor (perhaps one associated with a gaming establishment or a preferred travel company), a cocktail, a ticket to a show, a ticket to an event, a free meal, credit to play on a second gaming device, transfer of non-vested portions to a second gaming device, automatic enrollment in a player reward program, and the like.

RULES OF INTERPRETATION

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this patent application) nor the Abstract (set forth at the end of this patent application) is to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this patent application and the title of this patent application are for convenience only, and are not to be taken as limiting the disclosure in any way.

A player "wagers" at least a single "unit of wager" to pay for a game start. In many gaming devices, a unit of wager may be referred to as a credit. Many gaming devices allow multiple credits to be wagered concurrently in exchange for an improved paytable or more paylines. In many gaming devices, the unit of wager is a fractional dollar amount, or a coin (e.g., $0.05 (nickel) or $0.25 (quarter)). Thus, some paytables are expressed as a number of coins won relative to a number of coins wagered. In such instances, the term coin is the same as a unit of wager. Because gaming devices are embodied in different denominations, it is relevant to note that a coin, credit, or unit of wager on a first device may not be identically valued as a coin, credit, or unit of wager on a second device. For example, a credit on a quarter slot machine is not the same as a credit on a five-dollar slot machine.

"Determining" something can be performed in a variety of manners and therefore the term "determining" (and like terms) includes calculating, computing, deriving, looking up (e.g., in a table, database or data structure), ascertaining and the like.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software A "processor" means any one or more microprocessors, CPU devices, computing devices, microcontrollers, digital signal processors, or like devices.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth™, TDMA, CDMA, 3G.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as the described herein. In addition, the databases may, in a known manner, be stored locally or remotely from a device that accesses data in such a database.

Some embodiments can be configured to work in a network environment including a computer that is in communication, via a communications network, with one or more devices. The computer may communicate with the devices directly or indirectly, via a wired or wireless medium such as the Internet, LAN, WAN or Ethernet (or IEEE 802.3), Token Ring, SAP, ATP, Bluetooth, or via any appropriate communications means or combination of communications means. Each of the devices may comprise computers, such as those based on the Intel® Pentium® or Centrino™ processor, that are adapted to communicate with the computer. Any number and type of machines may be in communication with the computer. Communications over the Internet may be through a website maintained by a computer on a remote server or over an online data network including commercial online service providers, bulletin board systems, and the like. In yet other embodiments, the devices may communicate with one another and/or a computer over RF, cable TV, satellite links, and the like.

Devices in communication with each other need not be continually transmitting to each other. On the contrary, such computers and devices need only transmit to each other as necessary, and may actually refrain from exchanging data most of the time.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application.

The invention is claimed as follows:

1. A gaming system comprising:

at least one display device;

at least one input device;

at least one processor; and at least one memory device which stores a plurality of instructions which when executed by the at least one processor, cause the at least one processor to operate with the at least one display device and the at least one input device to:

(a) determine an outcome in association with a play of a game;

(b) display the determined outcome;

(c) determine if any immediate award is associated with the determined outcome;

(d) determine if any deferred award is associated with the determined outcome; and (e) at a first point in time:

(i) provide to a player any immediate award associated with the determined outcome, and (ii) not provide any deferred award associated with the determined outcome.

2. The gaming system of claim 1, wherein when executed by the at least one processor, the plurality of instructions cause the at least one processor to:

determine if at least one condition associated with any deferred award associated with the determined outcome is satisfied, if the at least one condition associated with any deferred award is satisfied, at a second, subsequent point in time, provide any deferred award associated with the determined outcome, and if the at least one condition associated with any deferred award is not satisfied, at the second, subsequent point in time, not provide any deferred award associated with the determined outcome.

3. The gaming system of claim 2, wherein when executed by the at least one processor, the plurality of instructions cause the at least one processor to provide the player any deferred award associated with the determined outcome if the at least one condition is satisfied.

4. The gaming system of claim 1, wherein any immediate award associated with the determined outcome are vested at the first point in time and any deferred award associated with the determined outcome are not vested at the first point in time.

5. The gaming system of claim 1, wherein the game is a wagering game.

6. The gaming system of claim 5, wherein the wagering game is configured to operate upon a placement of at least one wager of at least one non-monetary credit.

7. A method of operating a gaming system, said method comprising:

(a) causing at least one processor to execute a plurality of instructions to determine an outcome in association with a play of a game;

(b) causing at least one display device to display the determined outcome;

(c) causing the at least one processor to execute the plurality of instructions to determine if any immediate award is associated with the determined outcome;

(d) causing the at least one processor to execute the plurality of instructions to determine if any deferred award is associated with the determined outcome; and (e) at a first point in time:

(i) providing to a player any immediate award associated with the determined outcome, and (ii) not providing any deferred award associated with the determined outcome.

8. The method of claim 7, which includes:

causing the at least one processor to execute the plurality of instructions to determine if at least one condition associated with any deferred award associated with the determined outcome is satisfied, if the at least one condition associated with any deferred award is satisfied, at a second, subsequent point in time, providing any deferred award associated with the determined outcome, and if the at least one condition associated with any deferred award is not satisfied, at the second, subsequent point in time, not providing any deferred award associated with the determined outcome.

9. The method of claim 8, which includes providing the player any deferred award associated with the determined outcome if the at least one condition is satisfied.

10. The method of claim 7, wherein any immediate award associated with the determined outcome are vested at the first point in time and any deferred award associated with the determined outcome are not vested at the first point in time.

11. The method of claim 7, wherein the game is a wagering game.

12. The method of claim 11, wherein the wagering game is configured to operate upon a placement of at least one wager of at least one non-monetary credit.

13. The method of claim 7, which is executed through a data network.

14. The method of claim 13, wherein the data network is an internet.

15. A non-transitory computer readable medium including a plurality of instructions, which when executed by at least one processor, cause the at least one processor to:

(a) determine an outcome in association with a play of a game;

(b) cause at least one display device to display the determined outcome;

(c) determine if any immediate award is associated with the determined outcome;

(d) determine if any deferred award is associated with the determined outcome; and (e) at a first point in time:

(i) provide to a player any immediate award associated with the determined outcome, and (ii) not provide any deferred award associated with the determined outcome.

16. The non-transitory computer readable medium of claim 15, wherein when executed by the at least one processor, the plurality of instructions cause the at least one processor to:

determine if at least one condition associated with any deferred award associated with the determined outcome is satisfied, if the at least one condition associated with any deferred award is satisfied, at a second, subsequent point in time, provide any deferred award associated with the determined outcome, and if the at least one condition associated with any deferred award is not satisfied, at the second, subsequent point in time, not provide any deferred award associated with the determined outcome.

17. The non-transitory computer readable medium of claim 16, wherein when executed by the at least one processor, the plurality of instructions cause the at least one processor to provide the player any deferred award associated with the determined outcome if the at least one condition is satisfied.

18. The non-transitory computer readable medium of claim 15, wherein any immediate award associated with the determined outcome are vested at the first point in time and any deferred award associated with the determined outcome are not vested at the first point in time.

19. The non-transitory computer readable medium of claim 15, wherein the game is a wagering game.

20. The non-transitory computer readable medium of claim 19, wherein the wagering game is configured to operate upon a placement of at least one wager of at least one non-monetary credit.

* * * * *

UNITED STATES PATENT AND TRADEMARK OFFICE

CERTIFICATE OF CORRECTION

PATENT NO. : 8,506,388 B2
APPLICATION NO. : 13/417823
DATED : August 13, 2013
INVENTOR(S) : Jay S. Walker et al.

It is certified that error appears in the above-identified patent and that said Letters Patent is hereby corrected as shown below:

IN THE CLAIMS

In Claim 4, Column 25, Lines 49 and 51, replace “are” with --is--.
In Claim 10, Column 26, Lines 26 and 28, replace “are” with --is--.
In Claim 18, Column 27, Lines 8 and 9, replace “are” with --is--.

Signed and Sealed this
Twelfth Day of November, 2013

Teresa Stanek Rea
*Deputy Director of the United States Patent and Trademark Office*